US008602951B2

(12) United States Patent
Morris

(10) Patent No.: US 8,602,951 B2
(45) Date of Patent: Dec. 10, 2013

(54) VARIABLE RESISTANCE FITNESS CHAMBER FOR ROTATIONAL TORQUE

(76) Inventor: Nicholas Morris, Redondo Beach, CA (US)

( * ) Notice: Subject to any disclaimer, the term of this patent is extended or adjusted under 35 U.S.C. 154(b) by 197 days.

(21) Appl. No.: 13/109,652

(22) Filed: May 17, 2011

(65) Prior Publication Data

US 2011/0287909 A1 Nov. 24, 2011

Related U.S. Application Data

(60) Provisional application No. 61/395,784, filed on May 17, 2010, provisional application No. 61/395,823, filed on May 17, 2010, provisional application No. 61/395,819, filed on May 17, 2010, provisional application No. 61/395,822, filed on May 17, 2010, provisional application No. 61/395,847, filed on May 17, 2010, provisional application No. 61/395,817, filed on May 17, 2010.

(51) Int. Cl.

| | |
|---|---|
| ***A63B 23/00*** | (2006.01) |
| ***A63B 23/035*** | (2006.01) |
| ***A63B 23/12*** | (2006.01) |
| ***A63B 23/14*** | (2006.01) |
| ***A63B 21/00*** | (2006.01) |
| ***A63B 21/02*** | (2006.01) |
| ***A63B 21/045*** | (2006.01) |
| ***F16F 1/36*** | (2006.01) |
| ***F16F 1/38*** | (2006.01) |

(52) U.S. Cl.

USPC ..... 482/126; 482/44; 482/45; 482/46; 482/92; 482/121; 482/122; 482/127; 403/202; 403/203; 403/220; 403/225

(58) Field of Classification Search

USPC ..... 482/44–46, 83–86, 92–93, 111–119, 482/121–122, 126–130, 133–139; 403/164–165, 202–203, 221–223, 403/225–226

See application file for complete search history.

(56) References Cited

U.S. PATENT DOCUMENTS

| | | | | | |
|---|---|---|---|---|---|
| 2,543,729 | A | | 2/1951 | Magida | |
| 3,084,547 | A | * | 4/1963 | Nielsen | 73/379.08 |
| 3,184,234 | A | * | 5/1965 | Struble | 482/46 |
| 3,330,558 | A | * | 7/1967 | Simons, Jr. | 482/46 |
| 3,764,131 | A | * | 10/1973 | Rooks | 482/46 |
| 4,155,547 | A | * | 5/1979 | Savio et al. | 482/46 |
| 4,591,151 | A | | 5/1986 | Hensley | |
| 4,838,542 | A | * | 6/1989 | Wilkinson | 482/45 |
| 5,069,447 | A | | 12/1991 | Synderman et al. | |
| 5,184,986 | A | * | 2/1993 | Wilkinson et al. | 482/46 |
| 5,273,509 | A | | 12/1993 | Vittone | |
| 5,569,125 | A | | 10/1996 | Clementi | |

(Continued)

*Primary Examiner* — Loan Thanh
*Assistant Examiner* — Joshua Lee
(74) *Attorney, Agent, or Firm* — Superior IP, PLLC; Dustin L. Call

(57) ABSTRACT

One example embodiment includes a resistance chamber for use in an exercise system. The resistance chamber includes a first chamber and a second chamber. The second chamber is configured to attach to the first chamber and rotate relative to the first chamber. The resistance chamber also includes a core rod. The core rod resides within the first chamber and the second chamber and is attached to the interior of the second chamber. The resistance chamber further includes a resistance tube, where at least of a portion the resistance tube is configured to be placed between the interior surface of the first chamber and the core rod.

4 Claims, 6 Drawing Sheets

(56) References Cited

U.S. PATENT DOCUMENTS 5,643,158 A 7/1997 Clementi
5,665,041 A 9/1997 Hsieh
5,692,997 A 12/1997 Stearns
7,094,182 B1 * 8/2006 Holten ..... 482/46

* cited by examiner

VARIABLE RESISTANCE FITNESS CHAMBER FOR ROTATIONAL TORQUE

CROSS-REFERENCE TO RELATED APPLICATIONS

This application claims the benefit of and priority to U.S. Provisional Patent Application Ser. No. 61/395,784 filed on May 17, 2010, which application is incorporated herein by reference in its entirety.

This application is related to co-pending U.S. application Ser. No. 13/109,654, filed on May 17, 2011, and entitled, "BALL NEST WITH VARIABLE RESISTANCE FOR FITNESS AND WELLNESS MOVEMENT", which application is incorporated herein by reference in its entirety.

Co-pending U.S. application Ser. No. 13/109,654, filed on May 17, 2011, and entitled, "BALL NEST WITH VARIABLE RESISTANCE FOR FITNESS AND WELLNESS MOVEMENT" claims the benefit of and priority to U.S. Provisional Patent Application Ser. No. 61/395,823 filed on May 17, 2010, which application is incorporated herein by reference in its entirety.

This application is related to co-pending U.S. application Ser. No. 13/109,654, filed on May 17, 2011, and entitled, "VERTICAL MOVEMENT VIBRATING EXERCISE AND WELLNESS PLATFORM", which application is incorporated herein by reference in its entirety.

Co-pending U.S. application Ser. No. 13/109,658, filed on May 17, 2011, and entitled, "VERTICAL MOVEMENT VIBRATING EXERCISE AND WELLNESS PLATFORM" claims the benefit of and priority to U.S. Provisional Patent Application Ser. No. 61/395,819 filed on Mary 17, 2010, which application is incorporated herein by reference in its entirety.

This application is related to co-pending U.S. application Ser. No. 13/109,662, filed on May 17, 2011, and entitled, "VARIABLE-RESISTANCE FUNCTIONAL FITNESS BAG", which application is incorporated herein by reference in its entirety.

Co-pending U.S. application Ser. No. 13/109,662, filed on May 17, 2011, and entitled, "VARIABLE-RESISTANCE FUNCTIONAL FITNESS BAG" claims the benefit of and priority to U.S. Provisional Patent Application Ser. No. 61/395,822 filed on May 17, 2010, which application is incorporated herein by reference in its entirety.

This application is related to co-pending U.S. application Ser. No. 13/109,664, filed on May 17, 2011, and entitled, "VARIABLE RESISTANCE PULLEY FOR BODY-WEIGHT ROTATION EXERCISE", which application is incorporated herein by reference in its entirety.

Co-pending U.S. application Ser. No. 13/109,664, filed on May 17, 2011, and entitled, "VARIABLE RESISTANCE PULLEY FOR BODY-WEIGHT ROTATION EXERCISE" claims the benefit of and priority to U.S. Provisional Patent Application Ser. No. 61/395,847 filed on May 17, 2010, which application is incorporated herein by reference in its entirety.

This application is related to co-pending U.S. application Ser. No. 13/109,666, filed on May 17, 2011, and entitled, "TRI-CIRCULAR EXERCISE DEVICE WITH VARIABLE ROTATION RESISTANCE" , which application is incorporated herein by reference in its entirety.

Co-pending U.S. application Ser. No. 13/109,666, filed on May 17, 2011, and entitled, "TRI-CIRCULAR EXERCISE DEVICE WITH VARIABLE ROTATION RESISTANCE" claims the benefit of and priority to U.S. Provisional Patent Application Ser. No. 61/395,817 filed on May 17, 2010, which application is incorporated herein by reference in its entirety.

BACKGROUND OF THE INVENTION

The benefits of exercise are numerous and well documented. For example, exercise can reduce the instance and severity of many diseases. In addition, exercise can make a person feel better about themselves and provide the user with increased self-confidence and feelings of self-worth. However, many would be exercisers are intimidated by complex fitness machines and uncomfortable and unnatural motions associated with exercising. In addition, they may be reluctant to use heavy weights which can cause injury to the user.

Fitness machines have been made in the past that eliminate the heavy weights by using resistance within materials, such as elastic materials. These can allow the user to vary resistance. However, this creates the side effect of creating "reactive-force". I.e., as the user performs the exercise movement, the resistance being used causes a reaction force into the user's body. The greater the resistance, the greater the reactive force.

Reactive force can cause damage to the user's body if the resistance is too strong for a user and the exercise movement becomes uncontrolled. Additionally, reactive force can also accumulate a "break-down" effect in the ligaments, tendons or other soft tissues in the exercising user, and their associated muscle groups. Further, reactive force is a dissipated energy, and means a less than optimal result to the exerciser, meaning a poor return on time and effort invested in the exercise.

Additionally, many exercise systems allow only a single resistance setting. I.e., the system allows for a single exercise at a single resistance. This does not allow the exercise system to be used by individuals of different fitness levels. In particular, some individuals will be too new to exercising to use the exercise system while other individuals will be too advanced. Only the small group in the middle will be able to use the system.

In addition, elastic materials can rebound if the material fails. I.e., as the elastic material is stretched, the force is stored in the material. When the material fails the force in the material can cause sudden and unpredictable movement, which has potential to injure the user or damage the equipment. This is an inherent danger of the materials and the ability to reduce or eliminate this danger is very limited.

Further, many exercise systems use unnatural movements. I.e., they involve movements that the user does not perform when not doing that particular exercise. These unnatural movements can cause injury to the user. Often, the user will not even be aware of the injury until it becomes a major injury because they don't perform that movement unless exercising.

Accordingly, there is a need in the art for an exercise system which uses resistance that is not produced by elastic materials. Additionally, there is a need in the art for the exercise system to allow the user to select from variable resistance. Further, there is a need in the art for the system to prevent reactive forces from entering the user's body. Moreover there is a need for the exercise system to allow the user to exercise using natural movements.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a resistance chamber for use in an exercise system. The resistance chamber includes a first chamber and a second chamber. The second chamber is configured to attach to the first chamber and rotate relative to the first chamber. The resistance chamber also includes a core rod. The core rod resides within the first chamber and the second chamber and is attached to the interior of the second chamber. The resistance chamber further includes a resistance tube, where at least of a portion the resistance tube is configured to be placed between the interior surface of the first chamber and the core rod.

Another example embodiment includes a system for allowing a user to exercise. The system includes a resistance chamber. The resistance chamber includes a first portion and a second portion. The first portion is configured to rotate relative to the second portion. The system also includes a first ring attached to the first portion of the resistance chamber and a second ring attached to the second portion of the resistance chamber.

Another example embodiment includes a system for allowing a user to exercise. The system includes a resistance chamber. The resistance chamber includes a first chamber and a second chamber. The second chamber is configured to attach to the first chamber and rotate relative to the first chamber. The resistance chamber also includes a core rod. The core rod resides within the first chamber and the second chamber and is attached to the interior of the second chamber. The resistance chamber further includes a resistance tube, where at least of a portion the resistance tube is configured to be placed between the interior surface of the first chamber and the core rod. The resistance chamber additionally includes an adjustment knob, where the adjustment knob is configured to change the resistance to rotation of the second chamber relative to the first chamber. The system also includes a first ring and a first handle. The first handle is located at least partially within the interior of the first ring and is configured to rotate within the interior of the first ring. The system further includes a first ring attachment, where the first ring attachment is configured to attach the first ring to the first chamber. The system additionally includes a second ring and a second handle. The second handle is located at least partially within the interior of the second ring and is configured to rotate within the interior of the second ring. The system also includes a second ring attachment, where the second ring attachment is configured to attach the second ring to the second chamber.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
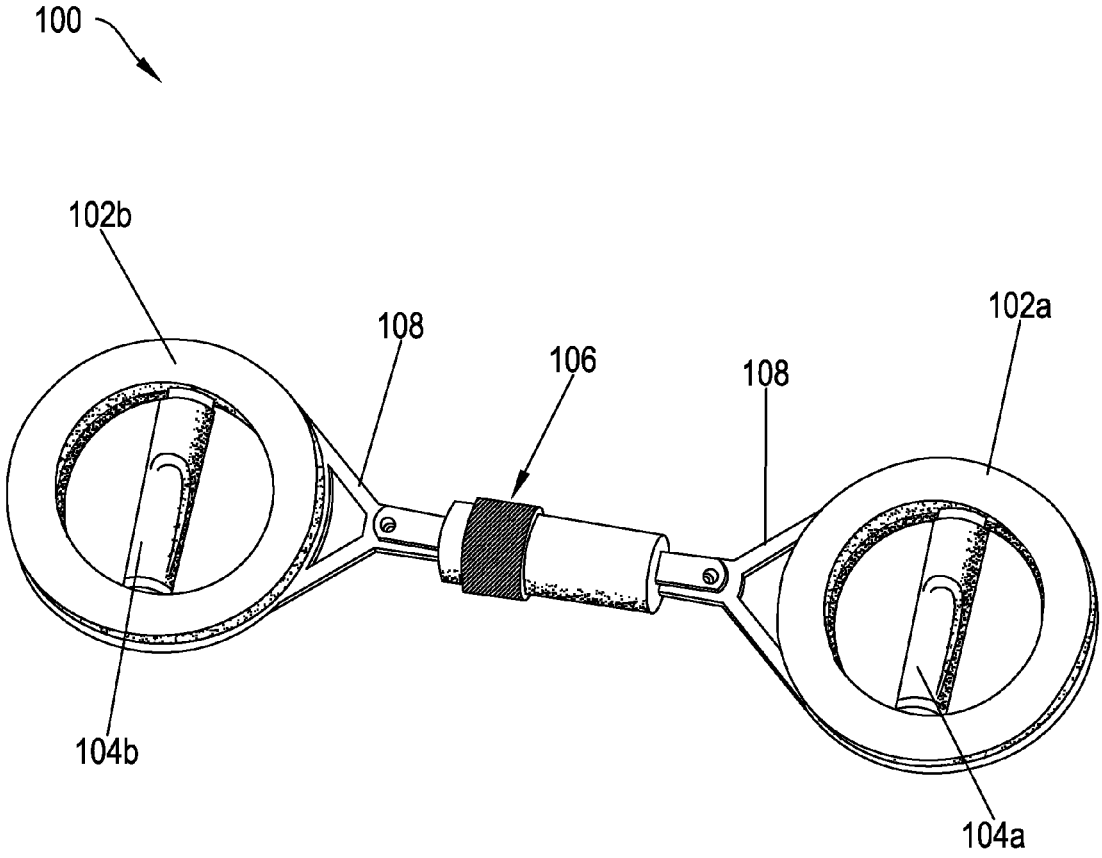
FIG. 1 illustrates an example of an exercise system.

FIG. 1 illustrates an example of an exercise system 100. In at least one implementation, the exercise system 100 can be used to increase the physical fitness of a user. In particular, the exercise system 100 can allow the user to perform a variety of movements with varying resistance. The resistance can be provided through friction rather than elasticity which reduces or eliminates the reactive force transmitted to the user's body. I.e., the exercise system 100 can increase his/her physical fitness with a reduced chance of injury.

FIG. 1 shows that the exercise system 100 can include a first ring 102*a* and a second ring 102*b* (collectively "ring 102" or "rings 102"). In at least one implementation, the rings 102 can move relative to one another. As the user moves the rings 102, the movement increases the user's physical fitness. In particular, the resistance to movement of the rings 102 can be increased or decreased as desired by the user. For example, the user can rotate the rings 102 relative to one another, with the resistance to rotation exercising the user's muscles.

FIG. 1 also shows that the first ring 102*a* and the second ring 102*b* can respectively include a first handle 104*a* and a second handle 104*b* (collectively "handle 104" or "handles 104"). In at least one implementation, the handles 104 can be held by a user during an exercise routine. In particular, the handles 104 can each be held in a user's hand. The exercise system 100 can then be used by the user to perform an exercise routine.

In at least one implementation, the handles 104 can rotate within the plane of the rings 102. For example, handles 104 can rotate relative to the rings 102. Additionally or alternatively, the handles 104 can be attached to a first portion of the rings 102 which can be rotated relative to the other portions of the rings 102. I.e., the rings 102 can include one or more portions, which are able to rotate relative to one another and the handles 104 can be attached to one or the portions of the rings 102.

FIG. 1 further shows that the exercise system 100 can include a resistance chamber 106. In at least one implementation, the resistance chamber 106 can provide resistance to the movements of the rings 102, as described below. In particular, the resistance chamber 106 can allow the user to adjust the resistance of the exercise system 100. The greater the resistance, the more the force the must exert to move the rings 102 relative to one another and relative to the resistance chamber 106 and the greater the health benefits to the user. In contrast, the lower the resistance, the less the force the must exert to move the rings 102 relative to one another and relative to the resistance chamber.

FIG. 1 further shows that the exercise system 100 can include one or more ring attachments 108. In at least one implementation, the one or more ring attachments 108 can allow the resistance chamber 106 to be connected to the rings 102. For example, the one or more ring attachments 108 can include a rivet, pin, bolt or the like attaching the ring attachments 108 to the resistance chamber 106, allowing the rings 102 to move relative to the resistance chamber 106. I.e., the one or more ring attachments 108 can allow the rings 102 to rotate relative to the attachment point. Additionally or alternatively, the one or more ring attachments 108 can allow the rings 102 to rotate in three dimensions, using a joint such as a ball and socket joint.

In at least one implementation, the exercise system 100 can include attachments other than the rings 102. In particular, the exercise system 100 can include any other attachment desired by the user. For example, the user can include attach a push up attachment. The push up attachment can include a first portion of a ring. The first portion can have a flat portion and/or a pad that is configured to be placed on the ground. The push up attachment can include a second portion of a ring. The second portion of the ring can be smaller than the first portion, such that the second portion is free to rotate within the circumference of the first portion. The second portion can be attached to the first portion such that it is configured to rotate about the first portion rather than the resistance chamber 106. Additionally or alternatively, the attachment can include an exercise bag, as described below.

In at least one implementation, the exercise system 100 can be configured to electronically communicate with an external device. For example, the exercise system 100 can be connected to a computer, a smart phone, a gaming console or any other electronic device. The electronic device can monitor the user's movements and/or the effectiveness of the user's exercise routine. For example, the electronic device can measure the user's heart rate or provide feedback for the user's exercise routine. E.g., the electronic device can monitor the motion of the various parts of the exercise system 100 and inform the user regarding motion that is overextended or underextended or regarding motion that includes starts and stops or interruptions to the user's exercise routine. Additionally or alternatively, the electronic device can provide information over numerous exercise sessions or routines. For example, the electronic device can show the user's progress as the user increases in strength and health.

The exercise system 100 can connect to the external device using any communications means. For example, the exercise system 100 can be physically connected or can be wirelessly connected to the external device. Additionally or alternatively, the exercise system 100 can connect to the external device using a network. The network exemplarily includes the Internet, including a global internetwork formed by logical and physical connections between multiple wide area networks and/or local area networks and can optionally include the World Wide Web ("Web"), including a system of interlinked hypertext documents accessed via the Internet. Alternately or additionally, the network includes one or more cellular RF networks and/or one or more wired and/or wireless networks such as, but not limited to, 802.xx networks, Bluetooth access points, wireless access points, IP-based networks, or the like. For example, the network can include cloud based networking and computing. The network can also include servers that enable one type of network to interface with another type of network.

Figure 2B:
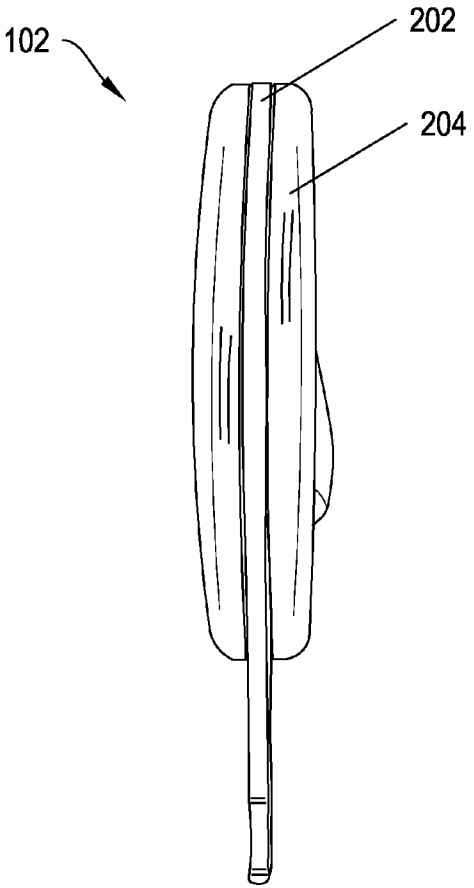
FIG. 2B illustrates a side view of the ring.
Figure 2A:
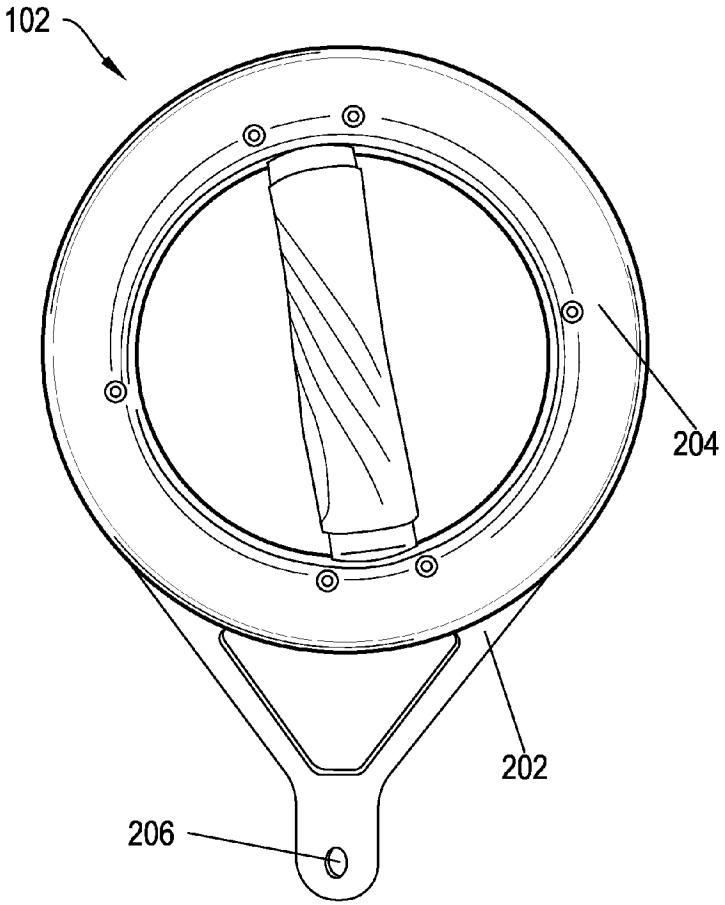
FIG. 2A illustrates a front view of a ring.

FIGS. 2A and 2B illustrate an example a ring 102. FIG. 2A illustrates a front view of the ring 102; and FIG. 2B illustrates a side view of the ring 102. In at least one implementation, the ring 102 can be used as part of an exercise system. One of skill in the art will appreciate that the ring 102 can be used with the exercise system 100 of FIG. 1; however, the ring 102 can be used with an exercise system other than the exercise system 100 of FIG. 1.

FIGS. 2A and 2B show that the ring 102 can include a first portion 202. In at least one implementation, the first portion 202 can be attached to the ring attachment 108. In particular, the first portion 202 can be attached to the ring attachment 108 such that the first portion 202 is not able to move relative to the ring attachment 108.

FIGS. 2A and 2B also show that the ring 102 can include a second portion 204. In at least one implementation, the second portion 204 can rotate relative to the first portion 202. In particular, the second portion 204 can be attached to the first portion 202, such that the center point of the first portion 202 and the center point of the second portion 204 coincide with one another. For example the second portion 204 can sandwich, or surround, the first portion 202. As the second portion 204 rotates around the center point, it rotates relative to the first portion 202.

FIGS. 2A and 2B further show that the ring attachment 108 can include an attachment point 206. In at least one implementation, the attachment point 206 can allow the ring 102 to be attached to an external device. For example, the ring 102 can be attached to a resistance chamber, such as the resistance chamber 106 of FIG. 1. The attachment point 206 can allow the ring to rotate or otherwise move with respect to the external device.

Figure 3:
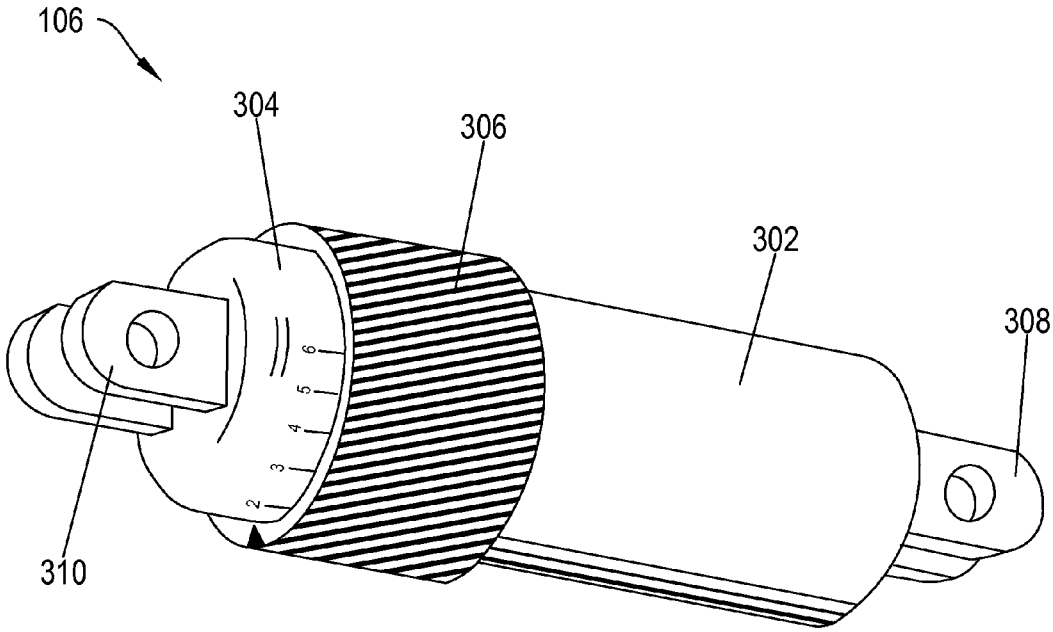
FIG. 3 illustrates an example of a resistance chamber.

FIG. 3 illustrates an example of a resistance chamber 106. In at least one implementation, resistance chamber 106 can provide rotational torque. The rotational torque can be created through the use of friction. I.e., the resistance chamber 106 can eliminate reactive force, or forces which enter the user's body from the resistance provided by the resistance chamber 106.

FIG. 3 shows that the resistance chamber 106 can include a first chamber 302. In at least one implementation, the first chamber 302 can include be hollow or otherwise contain elements for adjusting the resistance, as described below. The first chamber 302 can be made of metal, plastic, other polymers or any other suitable material.

FIG. 3 also shows that the resistance chamber 106 can include a second chamber 304. In at least one implementation, the second chamber 304 mates with the first chamber 304. In particular, the second chamber 304 is connected to, and can rotate relative to, the first chamber 302. The resistance to rotation of the first chamber 302 relative to the second chamber 304 can be adjusted, as described below. One of skill in the art will appreciate that the attachment between the first chamber 302 and the second chamber 304 need not be a direct attachment unless otherwise specified in the claims.

FIG. 3 further shows that the resistance chamber 106 can include an adjustment knob 306. In at least one implementation, the adjustment knob 306 can allow the user to change the resistance provided by the resistance chamber 106. In particular, the user can twist the adjustment knob 306 in order to increase or decrease the resistance, as desired. The adjustment knob 306 can include one or more markings to allow the user to determine the resistance. For example, the adjustment knob 306 can include numbers or other markers which can allow the user to easily identify the amount of resistance.

In at least one implementation, the adjustment knob 306 can move laterally with respect to the first chamber 302. For example, the adjustment knob 306 can include threading or other elements which translate rotational movement into lateral movement. The resistance knob 306 can be turned a first direction to increase resistance and turned the opposite direction to reduce resistance. Additionally or alternatively, the resistance knob 306 can include a maximum point with rotation from that point in either direction reducing the resistance, and a minimum point with rotation from that point in either direction increasing the resistance.

FIG. 3 additionally shows that the resistance chamber 106 can include a first link 308. In at least one implementation, the first link 308 allows the first chamber 302 to be attached to an external device. For example, the first link 308 can be attached to a ring, such as the ring 102 of FIGS. 1 and 2. Additionally or alternatively, the external device can include a rope, a bag, a cable or other exercise equipment.

FIG. 3 also shows that the resistance chamber 106 can include a second link 310. In at least one implementation, the second link 310 can allow the resistance chamber 302 to be attached to a second external device. For example, the second link 310 can attach the resistance chamber 106 to a device similar to the first external device. Additionally or alternatively, the second link 310 can allow the resistance chamber 106 to be attached to the first external device. The second link 310 can be attached to the same location on the first external device or in a different location. One of skill in the art will appreciate that a user can choose an external device specific to their choice of rotational torque exercise resulting from the resistance created by the resistance chamber 306.

Figure 4:
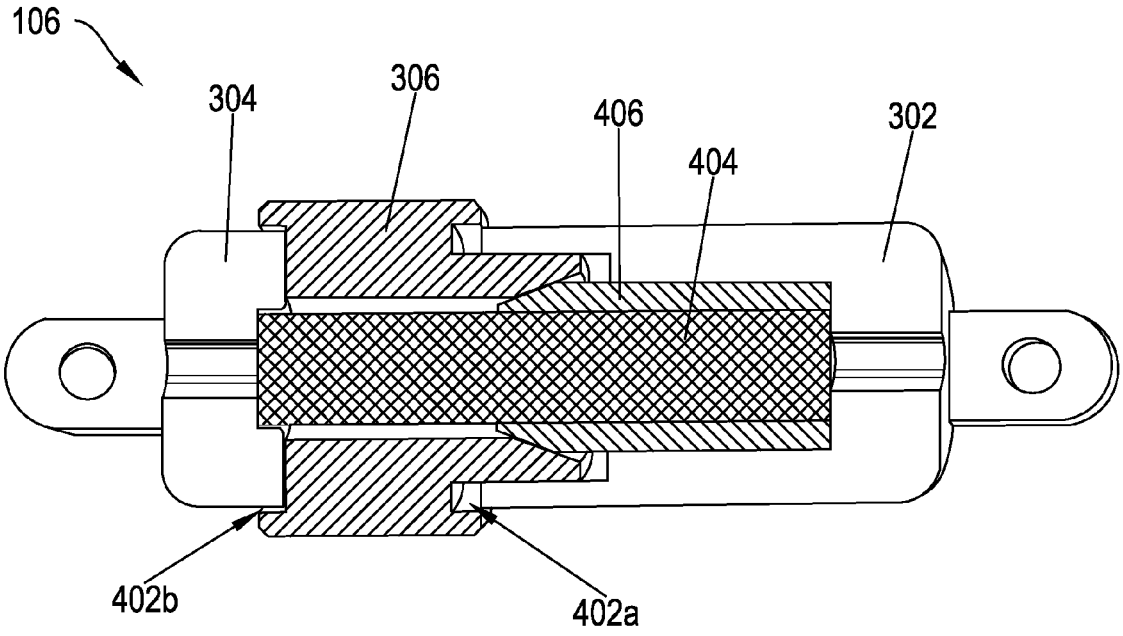
FIG. 4 illustrates a cross-section view of a resistance chamber.

FIG. 4 illustrates a cross-sectional view of a resistance chamber 106. In at least one implementation, the resistance chamber 106 can provide rotational torque. In particular, the resistance chamber can include elements which move past one another. As the elements move past one another, friction provides resistance to the movement. The friction can be increased or decreased to increase or decrease the resistance as desired by the user.

FIG. 4 shows that the adjustment knob 306 can include a first channel 402*a* and a second channel 402*b* (collectively "channels 402"). In at least one implementation, the first channel 402*a* and the second channel 402*b* are configured to receive the first chamber 302 and the second chamber 304 respectively. In particular, the channels 402 can allow the adjustment knob 306 to rotate relative to the first chamber 302 and the second chamber 304 while remaining attached to the first chamber 302 and the second chamber 304. This, in turn, can allow the first chamber 302 to rotate relative to the second chamber 304 and vice versa.

FIG. 4 also shows that the resistance chamber 106 can include a core rod 404. In at least one implementation, the core rod 404 can be located in the interior of the first chamber 302 and the second chamber 304 and provide rotation torque. The core rod 404 can be connected to both the first chamber 302 and the second chamber 304 allowing both the first chamber 302 and the second chamber 304 to rotate independent of one another. I.e., the core rod 404 can allow for the first chamber 302 to rotate relative to the second chamber 304 at a controlled resistance. The core rod 404 can include metal, metal alloys, plastics, rubbers or other polymers.

FIG. 4 further shows that the resistance chamber 106 can include a resistance tube 406. In at least one implementation, the resistance tube can provide the desired resistance within the resistance chamber 106. In particular, the resistance tube 406 can fit snuggly around the core rod 404 within the first chamber 302. The resistance tube 406 can be made from metal, plastic, rubber, other polymers or any other suitable materials.

FIG. 4 additionally shows that the adjustment knob 306 can be used to control the resistance. In particular, the adjustment knob 306 can interact with the resistance tube 406. The interaction between the resistance tube 406 and the adjustment knob 306 can be angled relative to the main axis of the resistance tube 406 and the adjustment knob 306. As the adjustment knob 306 moves laterally, the adjustment knob 306 pushes the resistance tube 406 with more or less force against the core rod 404. I.e., as the thickness of the interaction between the adjustment knob 306 and the resistance tube 406 increases, the adjustment knob 306 and the resistance tube 406 are pushed against both the core rod 404 and the interior of the first chamber 302 more strongly, making rotation of the first chamber 302 relative to the core rod 404 more difficult. In contrast, as the thickness of the interaction between the adjustment knob 306 and the resistance tube 406 decreases, the adjustment knob 306 and the resistance tube 406 are pushed against both the core rod 404 and the interior of the first chamber 302 less strongly, making rotation of the first chamber 302 relative to the core rod 404 less difficult.

Figure 5:
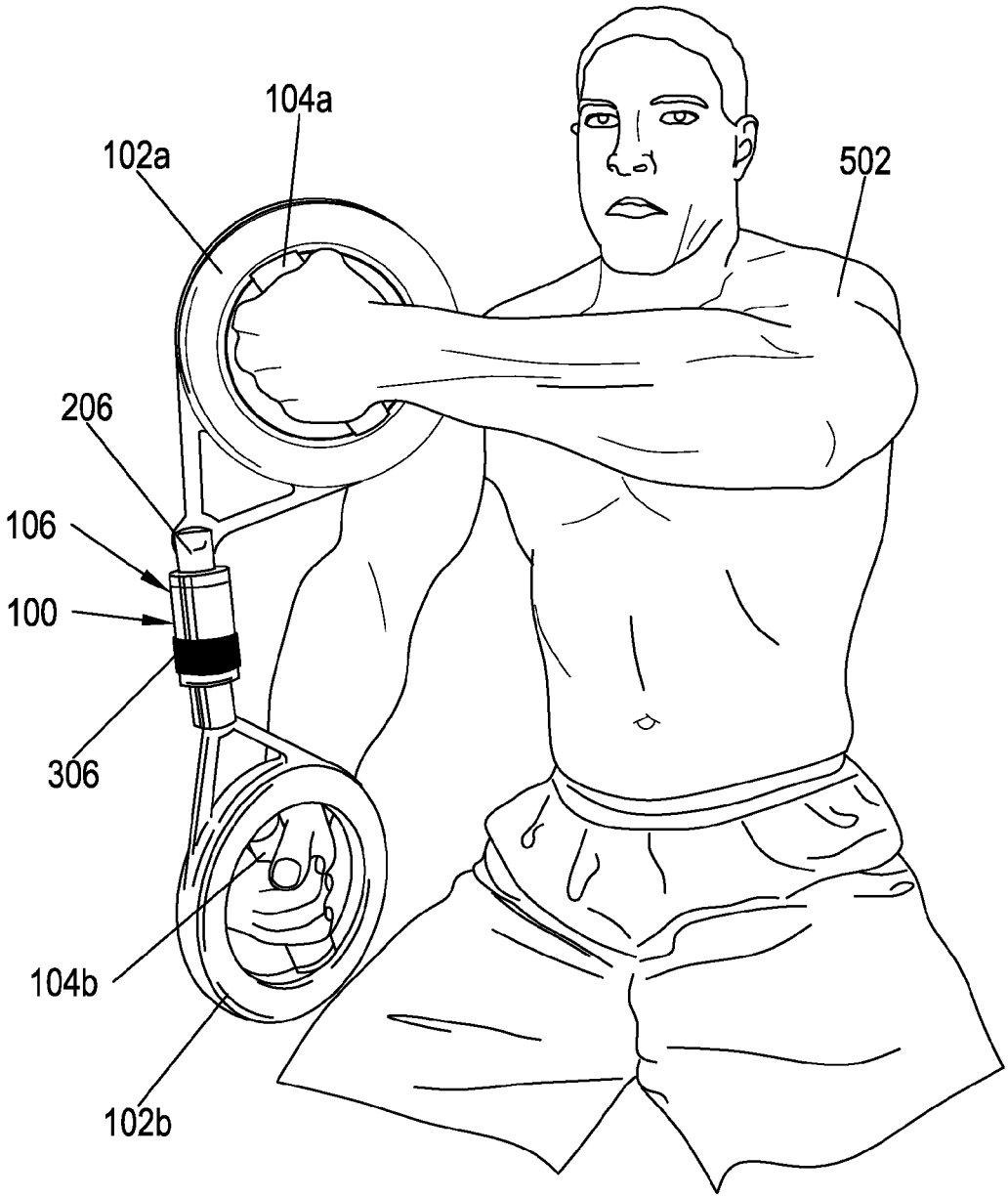
FIG. 5 illustrates an example of a user using the exercise system.

FIG. 5 illustrates an example of a user 502 using the exercise system 100. In at least one implementation, the user 502 can use the exercise system 100 to tone or strengthen his/her muscles. In particular, the exercise system 100 recreates natural movements of the human body, allowing the user 502 to exercise with little or no detrimental impact to the body of the user 502. I.e., the exercise system allows the user 502 to exercise using natural movements and low impact resistance.

FIG. 5 shows that the user 502 can hold the exercise system 100 using the handles 104. In at least one implementation, the user 502 can place one hand on the first handle 104*a* and the other hand on the second handle 104*b*. Movement of the user's 502 hands relative to one another are then limited by the exercise system 100.

FIG. 5 also shows that the user 502 can rotate the first ring 102*a* relative the second ring 102*b*. As the user 502 rotates the first ring 102*a* relative to the second ring 102*b* the resistance chamber 106 provides resistance to the rotation. The more resistance, the harder the user 502 must work to complete the rotation. The user 502 can adjust the resistance using the adjustment knob 306, as described above.

FIG. 5 further shows that the first ring 102*a* and the second ring 102*b* can swivel or otherwise move at the attachment point 206 to the resistance chamber 106. In at least one implementation, swiveling about the attachment point 206 can allow for more natural movement as the user 502 exercises. In particular, swiveling can allow the hands of the user 502 to move without being unnecessarily constrained within the plane of the swivel. I.e., the swivel removes rigidity which can help prevent harm to the user 502.

In at least one implementation, the user 502 can use a supplemental exercise device, such as a vertical movement vibrating exercise and wellness platform. An example of a vertical movement vibrating exercise and wellness platform is disclosed in co-pending U.S. application Ser. No. 13/109,658, filed on May 17, 2011, and entitled, "VERTICAL MOVEMENT VIBRATING EXERCISE AND WELLNESS PLATFORM", previously referenced. In particular, the user 502 can balance himself/herself on the platform while using the exercise system 100. However, the platform is moving up and down. Therefore, the user 502 must balance himself/herself while directing the movement of the rings 102, making the exercise routine more difficult and, consequently, more beneficial to the user.

Additionally or alternatively, the user 502 can use a supplemental exercise device, such as a tri-circular exercise device. An example of a tri-circular exercise device is disclosed in co-pending U.S. application Ser. No. 13/109,666, filed on May 17, 2011, and entitled, "TRI-CIRCULAR EXERCISE DEVICE WITH VARIABLE ROTATION RESISTANCE", previously referenced. In particular, the user 502 can balance himself/herself on the secondary plates or the main plates while using the exercise system 100. Therefore, the user 502 must balance himself/herself while directing the movement of the rings 102, making the exercise routine more difficult and, consequently, more beneficial to the user.

Additionally or alternatively, the user 502 can use other supplemental exercise devices, such as weights or other exercise systems, while using the exercise system 100.

Figure 6:
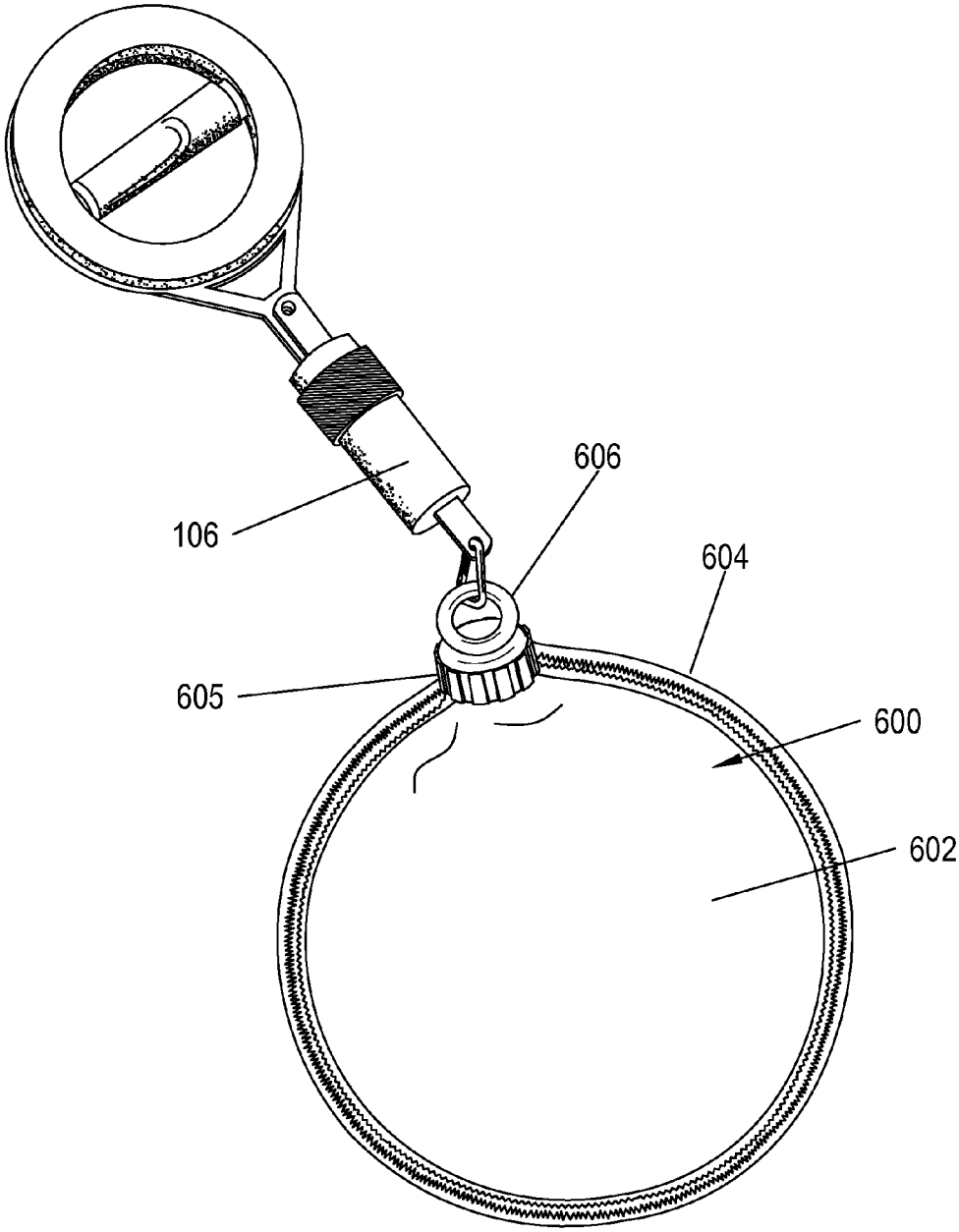
FIG. 6 illustrates an example of an exercise bag attached to the resistance chamber.

FIG. 6 illustrates an example of an exercise bag 600 attached to the resistance chamber 106. An example of an exercise bag is disclosed in co-pending U.S. application Ser. No. 13/109,662, filed on May 17, 2011, and entitled, "VARIABLE-RESISTANCE FUNCTIONAL FITNESS BAG", previously referenced. In at least one implementation, the exercise bag 600 is configured to support a large mass of fill material. The user can insert the fill material to exercise and remove the fill material when desired. In particular, the user can easily transport the exercise bag 600 for convenient exercise away from a home or gym, as the user can add fill material to exercise and remove fill material when done for convenience in travelling.

FIG. 6 shows that the exercise bag 600 can include a body 602. In at least one implementation, the body 602 is configured to hold a fill material. The fill material can add mass to the exercise bag 600 allowing a user to exercise using the bag as a weight. The fill material can include any desired material including sand, metal shot, water or any other fill material. The body 602 can be made of any suitable material of sufficient strength to support the fill material. For example, the body 602 can be made of neoprene.

FIG. 6 also shows that the exercise bag 600 can include a power rim 604. In at least one implementation, the power rim 604 is configured to hold the body 602 together. In particular, the body 602 can be made of two or more layers of material. The power rim 604 can hold the layers together and ensure that when the exercise bag 600 is being used in an exercise routine that the layers remain together. Additionally or alternatively, the power rim 604 can prevent the fill material from leaking out of the body 602. The power rim 604 can be made of any material with sufficient strength to hold the body together. For example, the power rim 604 can include a neoprene polymer mix.

FIG. 6 shows that the exercise bag 600 can include a collar 605. In at least one implementation, the collar 605 can provide an opening to the inside of the body 102. The fill material can be moved through the collar 605 by a user to either insert or remove fill material. The collar 605 can be of sufficient size or shape to make inserting the fill material easier for the user. For example, the collar 605 can include a large opening or a funnel shape.

FIG. 6 also shows that the exercise bag 600 can include a cap 606. In at least one implementation, the cap 606 is configured to cover the fill mechanism 400. In particular, the cap 606 can prevent filling material from being inserted or removed. For example, if the cap 606 is secured to the collar 605 the user can move the exercise bag 100 in any direction without the fill material exiting the body 102.

In at least one implementation, the exercise bag 600 can include an attachment mechanism. In at least one implementation, the attachment mechanism can secure the cap 606 to the collar 605. In particular, the attachment mechanism can ensure that the cap 606 remains attached to the collar 605 even during high force situations such as an exercise routine. For example, the attachment mechanism can include threading or other devices configured to secure the cap 606.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system for allowing a user to exercise, the system comprising:
- a resistance chamber, wherein the resistance chamber includes:
  - a first chamber;
  - a second chamber, wherein the second chamber is configured to:
    - attach to the first chamber; and
    - rotate relative to the first chamber;
  - a core rod, wherein the core rod:
    - resides within the first chamber and the second chamber; and
    - is attached to the interior of the second chamber;
  - a resistance tube, wherein at least a portion of the resistance tube is configured to be placed between the interior surface of the first chamber and the core rod; and
  - an adjustment knob, wherein the adjustment knob:
    - is configured to change the resistance to rotation of the second chamber relative to the first chamber; and
    - includes one or more markings to indicate the resistance setting to a user;
- a first ring;
- a first handle, wherein the first handle:
  - is located at least partially within the interior of the first ring; and
  - is configured to rotate within the interior of the first ring;
- a first ring attachment, wherein the first ring attachment is configured to attach the first ring to the first chamber;
- a second ring;
- a second handle, wherein the second handle:
  - is located at least partially within the interior of the second ring; and
  - is configured to rotate within the interior of the second ring; and
- a second ring attachment, wherein the second ring attachment is configured to attach the second ring to the second chamber.

2. The system of claim 1, wherein the first ring attachment is configured to allow the first ring to swivel within the plane of the first ring.

3. The system of claim 1, wherein the second ring attachment is configured to allow the second ring to swivel within the plane of the second ring.

4. The system of claim 1, wherein:
- the first ring includes:
  - a first layer, wherein the first layer is attached to the first ring attachment; and
  - a second layer, wherein the second layer is able to rotate freely with respect to the first layer;
  - wherein the first handle is attached to the second layer; and
- the second ring includes:
  - a first layer, wherein the first layer is attached to the second ring attachment; and
  - a second layer, wherein the second layer is able to rotate freely with respect to the first layer;
  - wherein the second handle is attached to the second layer.

* * * * *